US005734990A

United States Patent [19]

Waring

[11] Patent Number: 5,734,990

[45] Date of Patent: Apr. 7, 1998

[54] WEARABLE ARTICLE FOR ATHLETE WITH VORTEX GENERATORS TO REDUCE FORM DRAG

[76] Inventor: John Waring, 608 Tourelle Drive, Orleans, Ontario, Canada, K4A 3H5

[21] Appl. No.: 613,515

[22] Filed: Mar. 11, 1996

[30] Foreign Application Priority Data

Mar. 10, 1995 [CA] Canada ..... 2144350

[51] Int. Cl.[6] ..... A41D 1/00

[52] U.S. Cl. ..... 2/69; 2/425; 2/67; 2/10

[58] Field of Search ..... 2/69, 79, 80, 2.15, 2/102, 108, 227, 228, 238, 410, 422, 425, 10, 421, 67, 243.1

[56] References Cited

U.S. PATENT DOCUMENTS

| | | | |
|---|---|---|---|
| 2,800,291 | 7/1957 | Stephens | 244/41 |
| 4,075,714 | 2/1978 | Ryder et al. | 2/421 |
| 4,455,045 | 6/1984 | Wheeler . | |
| 4,564,959 | 1/1986 | Zahn | 2/410 |
| 4,972,522 | 11/1990 | Rautenberg | 2/67 |
| 5,033,116 | 7/1991 | Itagaki et al. | 2/67 |
| 5,052,053 | 10/1991 | Peart et al. | 2/243.1 |
| 5,058,837 | 10/1991 | Wheeler . | |
| 5,106,331 | 4/1992 | Lizarazu | 2/69 |
| 5,380,578 | 1/1995 | Rautenberg | 2/67 |

FOREIGN PATENT DOCUMENTS

| | | |
|---|---|---|
| 0411351 | 6/1991 | European Pat. Off. . |
| 9318673 | 9/1993 | WIPO . |
| 9419975 | 9/1994 | WIPO . |

OTHER PUBLICATIONS

Pritchard, William G. and Jonathan K. Pritchard, "Mathematical Models of Running", *American Scientist*, pp. 546–553.

*Primary Examiner*—Gloria Hale
*Attorney, Agent, or Firm*—Marks & Clerk

[57] ABSTRACT

A drag reduction arrangement for the body of an athlete moving through a fluid medium, comprises a device attachable to the athlete's body for delaying the onset of boundary layer separation at a trailing surface thereof. The device preferably comprises an array of vortex generators. As a result, form drag is reduced by an amount which is substantially greater than any increase in skin friction due to the presence of the vortices.

16 Claims, 4 Drawing Sheets

WEARABLE ARTICLE FOR ATHLETE WITH VORTEX GENERATORS TO REDUCE FORM DRAG

BACKGROUND OF THE INVENTION

This invention relates to a drag reduction arrangement for the body of an athlete moving through a fluid medium.

Many athletic sports inherently involve the athlete moving his body through a fluid medium, usually air or water. Typically, such sports are swimming, cycling, skiing, and speed skating.

The drag on these athletes can be broken down into three main sub types, namely wave drag, skin friction drag, and form drag.

Wave drag results when a body moves on the surface of a fluid producing a wake (only the swimmer when on the surface of the water encounters this type of drag).

Skin friction drag results from the viscosity of the fluid and is applicable to all of the sports listed above. Fluid in contact with the surface of a body in motion decelerates to zero velocity with respect to the body. The difference in velocity this creates between the free stream flow and the skin of the body results in a finite shear region called a boundary layer. This boundary layer grows in thickness as it progresses from the front of the body to the back. In addition, the boundary layer may progress through two different states depending on flow conditions. In the laminar state, the flow is smooth and the skin friction drag is low. In the turbulent state, a laminar boundary layer may 'transition' to a turbulent one under the right conditions. This results in higher skin friction.

Form drag occurs if boundary layer flow encounters an adverse pressure gradient, i.e., a region where the flow decelerates. The flow separates from the body resulting in the formation of large Eddies creating a low pressure region aft of the body. This can result in a dramatic increase in drag over a flow which remains attached. Unfortunately, laminar boundary layers, which have the lowest drag are also the most susceptible to separation.

With respect to the sports listed above, drag reduction efforts to date have largely concentrated on reducing skin friction drag. For example, it has been proposed to delay the development or reduce the intensity of a turbulent boundary layer by smoothing the body surface and employing streamwise riblets. Such a measure, however, has the effect of hastening boundary layer separation. A typical example of such a method is described in U.S. Pat. No. 5,033,116.

An alternative method involves covering the surface with a lubricant which is shed in the flow thereby reducing the net shear stress at the body surface.

However, since humans are not streamlined, surprisingly reducing the skin friction drag may actually increase the overall drag because delaying transition to a turbulent boundary layer or decreasing the intensity of the turbulent layer may induce earlier separation when the flow encounters an adverse pressure gradient, such as occurs in the vicinity of a curved surface. This effect may dramatically increase form drag, more than offsetting any gains from reduced skin friction.

In fact, a major source of drag in many racing sports results from flow separation at curved surfaces on the athlete's body, such as at the athlete's posterior, arms or back of the head. This is known as form drag. Specifically the sports which are most affected by this type of drag include any sport in which the athlete's torso is aligned with the direction of motion.

Classically, form drag is reduced by altering the shape of the object in the flow to more closely approximate a streamline shape. This is often not practical in the case of a human being. When practical, such methods are generally outlawed by the applicable sports governing body. For example, fairings are generally illegal in almost all sanctioned cycling races. Consequently, any method which reduces drag must also be subtle in order to avoid prohibition.

An object of the invention is to reduce the overall drag on an athlete moving through a fluid medium.

SUMMARY OF THE INVENTION

According to the present invention there is provided a wearable article for use by a person moving rapidly through a fluid medium in a longitudinal direction, said longitudinal direction defining a direction of fluid flow relative to said person, and said article having a drag reduction arrangement comprising an upstream row and at least one additional row of spaced vortex generators secured to said article, at least said upstream row being located on a line at least just upstream of a surface that is curved in said longitudinal direction, each said row of vortex generators being arranged so as to extend in a transverse direction relative to said fluid flow when said article is worn, and said vortex generators being oriented so as to create trailing vortices extending in said longitudinal direction and having a height sufficient to extend about ¼ to ½ the way into a boundary layer formed by the motion of the person through the fluid medium, whereby said vortex generators delay the onset of boundary layer separation and thereby reduce form drag.

The vortex generator should be located just upstream of the points of anticipated flow separation on the trailing surface, i.e. upstream of a portion of the body that curves away from the relative fluid flow, such as just upstream of the athlete's posterior, back of his head, or on the sides of his arms or legs.

By delaying the onset of boundary layer separation is meant the fact that flow separation occurs further downstream of the relative fluid flow than would be the case without such means. The word delaying is employed more in a spatial sense than temporal as is customary in the art of fluid dynamics.

In a preferred embodiment, the means attachable to the athlete's body comprises one or more vortex generators, preferably an array of vortex generators. Vortex generators are passive devices which create vortices whose axis of rotation is oriented parallel to the flow. This has the effect of transporting high speed flow from the free stream into the near wall region, which tends to prevent flow separation. Since the vortices persist far downstream of the generators themselves, the method is very effective at preventing separation. Furthermore since these devices also trip a laminar boundary layer into a turbulent one, they are effective in a wide variety of flow conditions. The miniature vortices extend about ¼ to ½ the way into the boundary layer. While the vortices increase skin friction, this increase is more than offset by the delay in the onset of boundary layer separation. The reduction in form drag due to the delay in the onset of boundary layer separation is thus substantially greater the increase in skin friction due to the presence of vortices.

Various shapes, such as V's, wedges, and cylinders, can be employed for this purpose. A preferred type is a Stephen's vortex generator, which is in the form of an wedge with an angled upper surface. Such a vortex generator is described in U.S. Pat. No. 2,800,291, which is incorporated herein by reference. The vortex generators are preferably arranged in rows across the flow direction and continue around the surface to the point where flow separation takes place.

The vortex generators can be made, for example, of suitable flexible plastic material, for example sewn, molded, or glued into an athlete's garment, such as a swimsuit or cycling suit.

The induced drag is more severe downstream of steeply curved surfaces. Thus, on steeper curves, such as in the buttock or head areas, it is desirable to have several rows of vortex generators continuing up to the point of inevitable separation. Where the curve is shallower, such as in the back area, only one row will generally be sufficient. There is a trade-off. The vortex generators increase the frictional drag, due to their projection into the medium and the vortex generation, but in accordance with the invention any such increase is more than offset by the reduction in form drag.

Generally, the vortex generators should extend about ¼ to ½ the way into the boundary layer, which in the case of a swimmer is about 1" (2.5 cms.) thick. The vortex generators typically generate vortices that extend about ¼ to ½ way into the boundary layer. By bringing faster moving fluid into contact with the surface of the body, they delay the onset of boundary layer separation in a manner which is known per se in relation to aerodynamic bodies. The thickness of the boundary layer is generally about 1" in air as well because the athlete is moving a lot faster. It generally widens from the stagnation point on the leading edge of the body toward the rear.

The invention depends on the fact that, in an adverse pressure gradient, the velocity profile of the boundary layer eventually becomes inflected. Essentially, a near wall sub-layer of low speed flow begins to grow in thickness which causes the boundary layer to lose adherence. This condition results in separation if the adverse pressure region continues too long or the pressure gradient increases. By introducing high energy (i.e. high speed) fluid into the near-wall portion of the boundary layer, for example through the use of the vortex generators described above, the onset of boundary layer separation can be delayed. Five methods of achieving this result are boundary layer tripping, boundary layer suction, boundary layer injection, and vortex generators.

In boundary layer tripping, a laminar boundary layer can be tripped to a turbulent one by toughening the object's surface or by placing an obstacle in the flow. However, if the flow is already turbulent, this strategy will be ineffective and will, in fact, hasten any separation of the boundary layer. The boundary layer must therefore be tripped in a laminar flow region.

Boundary layer suction involves a series of pores on the surface of the object which literally remove the near wall low energy flow.

While the other techniques could be employed, vortex generators show the most promise for significantly reducing the overall drag in the aforementioned sports. The vortex generators themselves are conveniently solid pieces attached at key flow points on the athlete's garment. Specifically the devices are attached at points upstream of anticipated flow separation and continuing round the curved body to the point of flow separation. The most significant regions of flow separation are the head and posterior of an athlete in the case of a swimmer, and in the case of a cyclist also include sides of the torso, the arms and legs. For example, air meeting the legs separates as it curves round the curved portion of the leg creating form drag in its wake.

The invention also provides a method of reducing the drag of a person moving rapidly through a fluid medium in a longitudinal direction, said longitudinal direction defining a direction of fluid flow relative to said person, and said fluid defining a boundary layer in the vicinity of the person, said method comprising the step of arranging an upstream row and at least one additional row of spaced vortex generators on said person, each said row of vortex generators being arranged so as to extend in a transverse direction relative to said fluid, and at least said upstream row being located upstream of a line of boundary layer flow separation, said vortex generators being oriented so as to create trailing vortices extending in said longitudinal direction and having a height sufficient to extend about ¼ to ½ the way into said boundary layer, said trailing vortices delaying the onset of boundary layer separation and thereby reducing form drag.

The invention further provides an athlete's garment having attached thereto means for delaying the onset of boundary layer separation at a trailing surface of the athlete's body.

The invention also provides an athlete's body suit having provided thereon means for delaying the onset of boundary layer separation at trailing surfaces thereof during an athletic activity, said means comprising vortex generators located at points just upstream of said trailing curved surfaces.

The invention still further provides an athletic helmet comprising means extending thereacross on the top surface thereof to delay the onset of boundary layer separation.

BRIEF DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
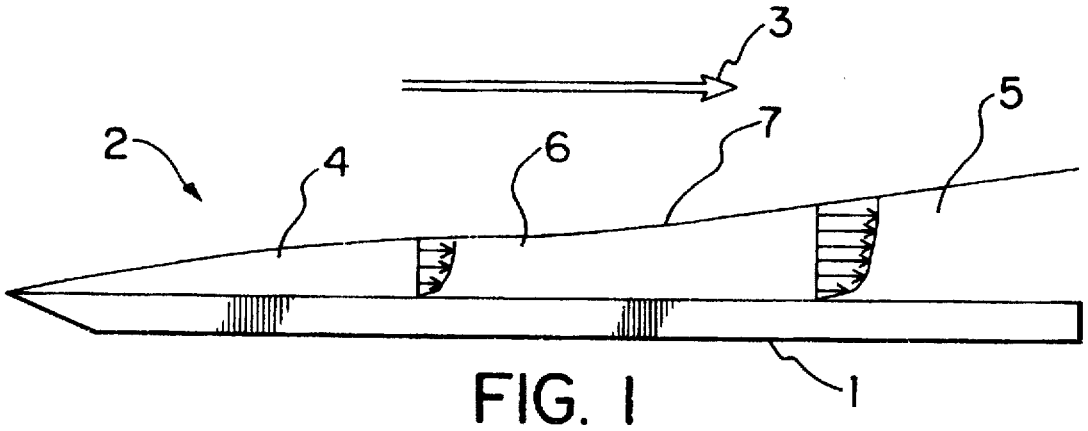
FIG. 1 illustrates the boundary layer separation process that applies to bodies moving through a fluid medium.

Referring now to FIG. 1, a solid object 1 is moving relative to a fluid medium 2, such as water or air. The fluid flow direction is shown by arrow 3. Of course, it is the relative motion that is important. It is immaterial whether it is the body or fluid that is moving. It is customary to reference the fluid movement to the body. Thus, when considering the boundary layer, which is the region where fluid flow is affected by the presence of the body, it is customary to refer to the streamline closest to the body as stationary and the streamline furthest from the body as fast-moving.

It is known from the laws of fluid mechanics that flow in the boundary layer 7 can be turbulent or laminar. As the object moves through the fluid, three regions are created. In the forward region 4, the flow is essentially laminar close to the surface of the body 1. This is the region of lowest skin friction drag.

In the aft region 5, the flow is essentially turbulent. Here, there is a much higher skin friction.

A transition region 6 is present between the forward and aft regions 4, 5, where the flow close to the body changes from laminar to turbulent.

If the boundary layer, which is the region where fluid flow is affected by the presence of the body, encounters an adverse pressure gradient, i.e., a region where the flow decelerates, the flow may separate from the body, resulting in the formation of Eddies 9 (FIG. 2), which result in a low pressure region aft of the body. These Eddies, which unlike the vortices rotate about transverse axes, result in a dramatic increase in drag relative to a flow that remains attached.

Laminar boundary layers, which have the least skin friction drag, are the most susceptible to separation. Turbulent boundary layers, while exhibiting higher skin friction, are, however, less susceptible to flow separation.

Figure 2:
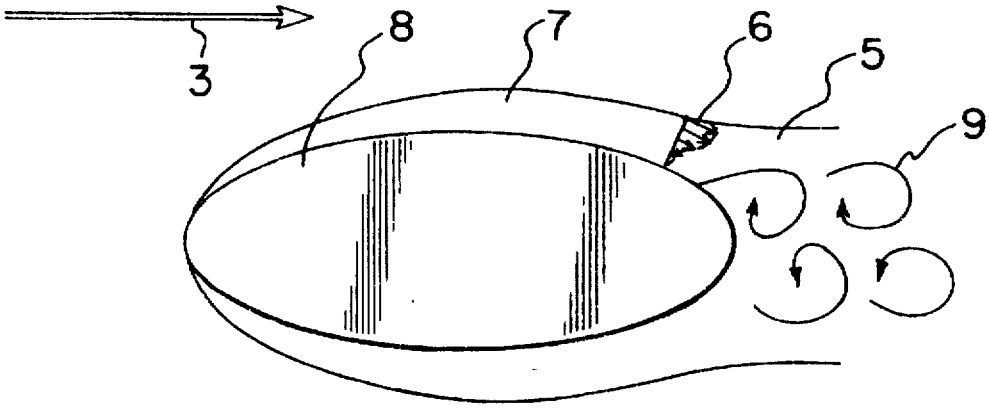
FIG. 2 illustrates the production of form drag.

FIG. 2 shows a streamlined body 8 designed to delay the onset of separation in boundary layer 7 and thus reduce form drag. Flow separation occurs in transition region 6, resulting in the formation of trailing Eddies 9 aft of the body 8. The streamlining of the shape helps to push the region 6 aft as much as possible, resulting in a reduction in form drag.

With mechanical devices, form drag can be reduced in this way by careful design of the shape of the object. In the case of the human body, this is not usually feasible. Thus in order to reduce form drag, in accordance with the invention, a device is attached to the boundary that is designed to delay the onset of boundary layer separation.

Figure 3:
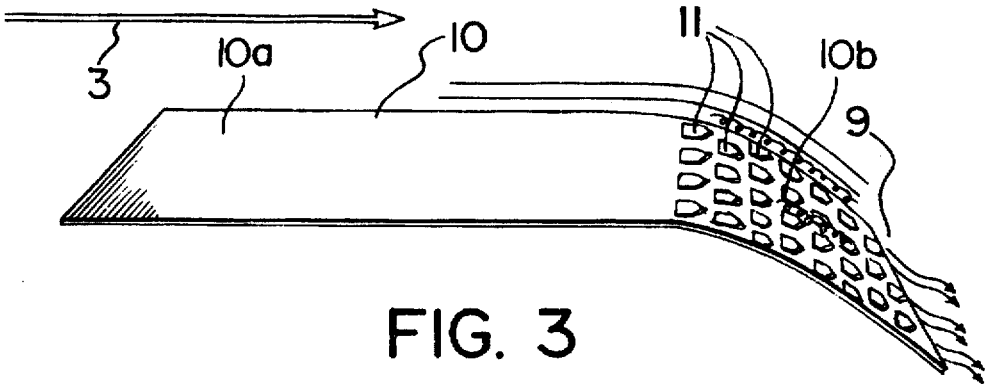
FIG. 3 shows the effect of vortex generators in accordance with the invention.

FIG. 3 illustrates the principle. Fluid flowing over plane surface 10*a* flows in a laminar fashion until it meets curved region 10*b*. In the absence of vortex generators 11, it would begin to follow the curve and then very quickly separate, creating large Eddies similar to Eddies 9 in FIG. 2. These Eddies create large amounts of form drag.

If vortex generators 11 are placed strategically in rows on the surface 10 just upstream of the curved region 10*b*, where flow separation of the boundary layer is expected to occur, the onset of boundary layer separation can be delayed and consequently the form drag can be reduced. The rows of vortex generators continue round the curved region 10*b* until the point where flow separation becomes inevitable. Experiments have shown that the array of vortex generators 11 effectively causes the streamlines to remain attached to the curved surface 10*b* and thus delay the onset of boundary layer separation. This results in a reduction in form drag.

The vortex generators 11 thus serve to delay the onset of boundary flow separation by increasing the energy of the fluid flow, thus significantly reducing form drag. They produce miniature vortices spiraling about a longitudinal axis extending generally parallel to the surface along the streamlines. Generally, they extend about ¼ to ½ the way into the boundary layer, and their effect is to bring higher speed, higher energy air into the lower regions of the boundary layer and allowing it to maintain contact with the surface of the body.

FIGS. 4*a* to 4*g* illustrate suitable vortex generators 11, which can be attached in rows just upstream of a curved portion of the athlete's body, and preferably continuing around the curve to the point of inevitable flow separation. The vortex generators may be sewn, molded or glued into the athlete's garment, such as a body suit 12.

Figure 4A:
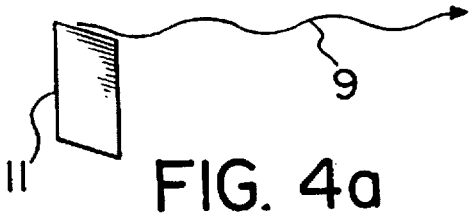
FIGS. 4*a* to 4*g* show various types of vortex generator.
Figure 4B:
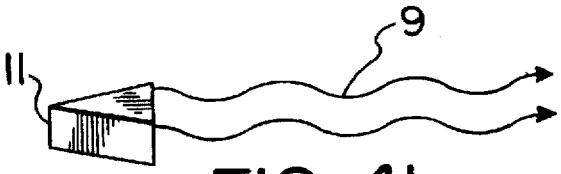
Figure 4C:
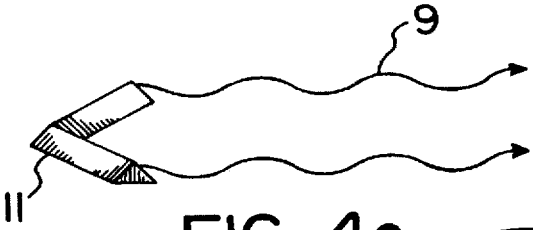
Figure 4D:
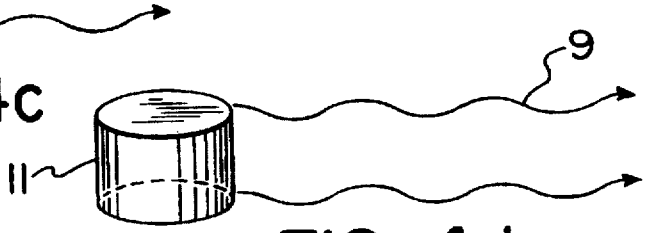

FIG. 4*a* shows a simple wing shape, which is placed at an angle to the fluid flow. FIG. 4*b* shows a wedge shape, and FIG. 4*c* shows a Vee shape. FIG. 4*d* shows a cylinder, FIG. 4*e* a truncated sphere or cap, and FIG., 4*f*, an airfoil section. Each of these devices will produce a trailing vortex when placed in a fluid stream.

Figure 4E:
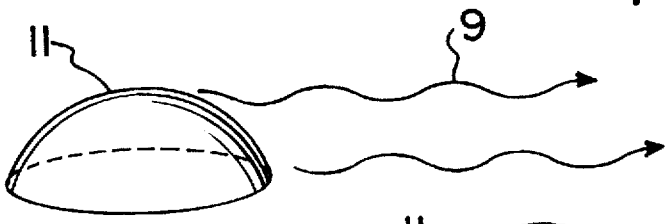
Figure 4F:
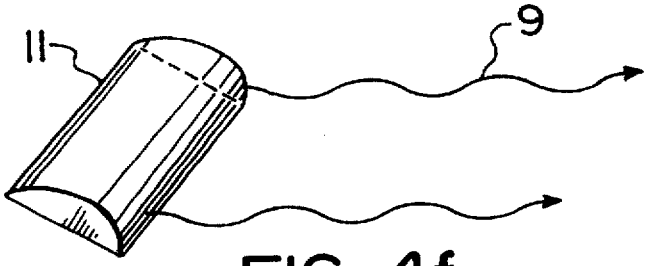
Figure 4G:
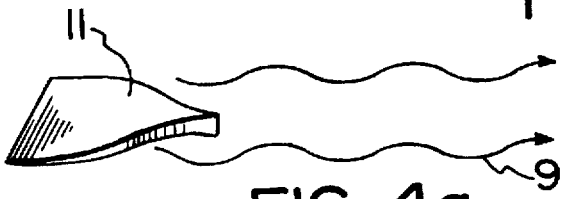

FIG. 4*g* shows a shape which has proved to be most effective in tests. This is known as a Stephen's generator described in U.S. Pat. No. 2,800,291 referred to above, and consists of a generally wedge-shaped form with concavely curved sides and having an upper surface truncated at an angle from the front to rear edges, the front and rear edges lying in perpendicular planes. Fluid flow strikes the inclined upper side edges and as it does so spirals off forming downstream vortices.

Other suitable vortex generators are described in U.S. Pat. Nos. 5,088,837 and 4,455,045, which are incorporated herein by reference.

Figure 5:
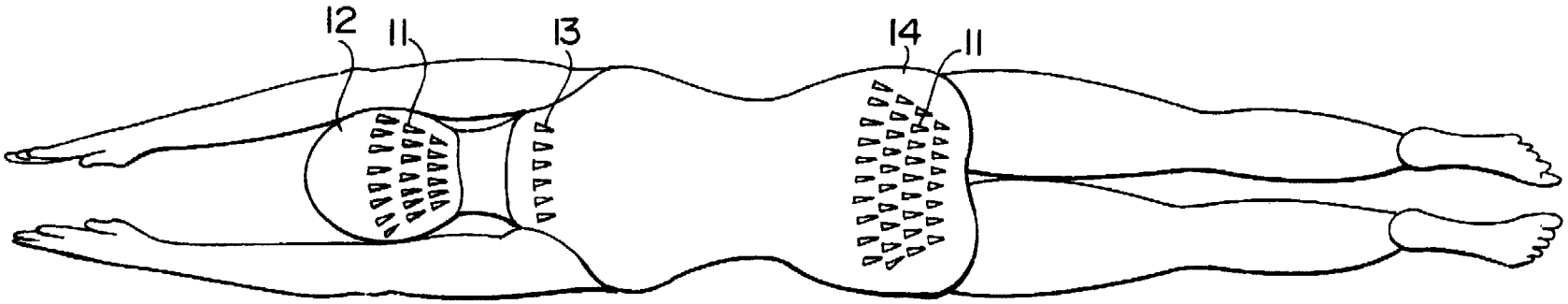
FIGS. 5 and 6 are rear and side views of a swimmer respectively.
Figure 6:
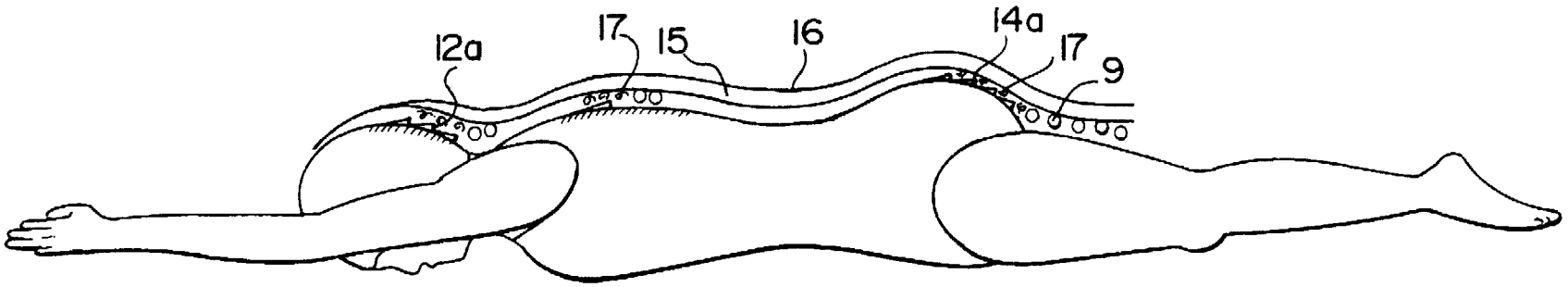

FIGS. 5 and 6 show respectively the rear and front sides of a swimmer. The Stephen's vortex generators 11, consisting of small flexible plastic pieces, are molded in rows on the athlete's head 12, back 13, and buttock 14, commencing just upstream of the trailing curve and continuing round it to the point where boundary layer separation becomes inevitable. In the rear portions 12*a* of the head and 14*a* of the buttock, which have a steeper curvature, several parallel rows of staggered vortex generators are provided since the boundary layer separation is more pronounced in these regions. In the back region 13, where the curvature is shallower, only one row is desirable since there is a trade-off. The vortex generators increase skin friction and the objective is to ensure that any such increase is more than offset by the reduction in form drag.

FIG. 6 shows streamlines 15 and 16 set (not to scale) ½" and 1" respectively from the surface of the body, assuming for a swimmer a boundary layer thickness of 1", which is typical. The vortex generators typically protrude ¼ the way into the boundary layer and the resulting vortices 17 extend about ½ the way into the boundary layer, bringing the higher energy air into contact with the athlete's body. The boundary actually becomes thicker from the stagnation point over the head toward the rear of the body. The height of the vortex generators relative to the thickness of the boundary layer depends not only on the curvature of the trailing surface but also the length over which they have effect. The more the vortex generators protrude above the surface, the greater the distance over which the generated vortices will be sustained, but of course also the greater the frictional drag. In the case of the back, the single row of generators has about the same height as those over the buttock because although the curvature is less, they must have an effect over a greater distance. Typically, a Stephen's vortex generator may be ¼" high, 1" wide, and 2" long.

Miniature vortices are generated at each generator, and these swirl along the surface of the body increasing the energy of the water and thus delaying the onset of boundary layer separation. The vortices 17 follow contours 15, 16. As a result, form drag is significantly reduced and the athlete's performance enhanced. The form drag can be reduced in some circumstances up to 5 or 10%.

The vortex generators 11 can be conveniently formed as part of the athlete's body suit 12, which can also employ conventional skin-friction reducing technology, such as lubricants and the like.

Figure 7:
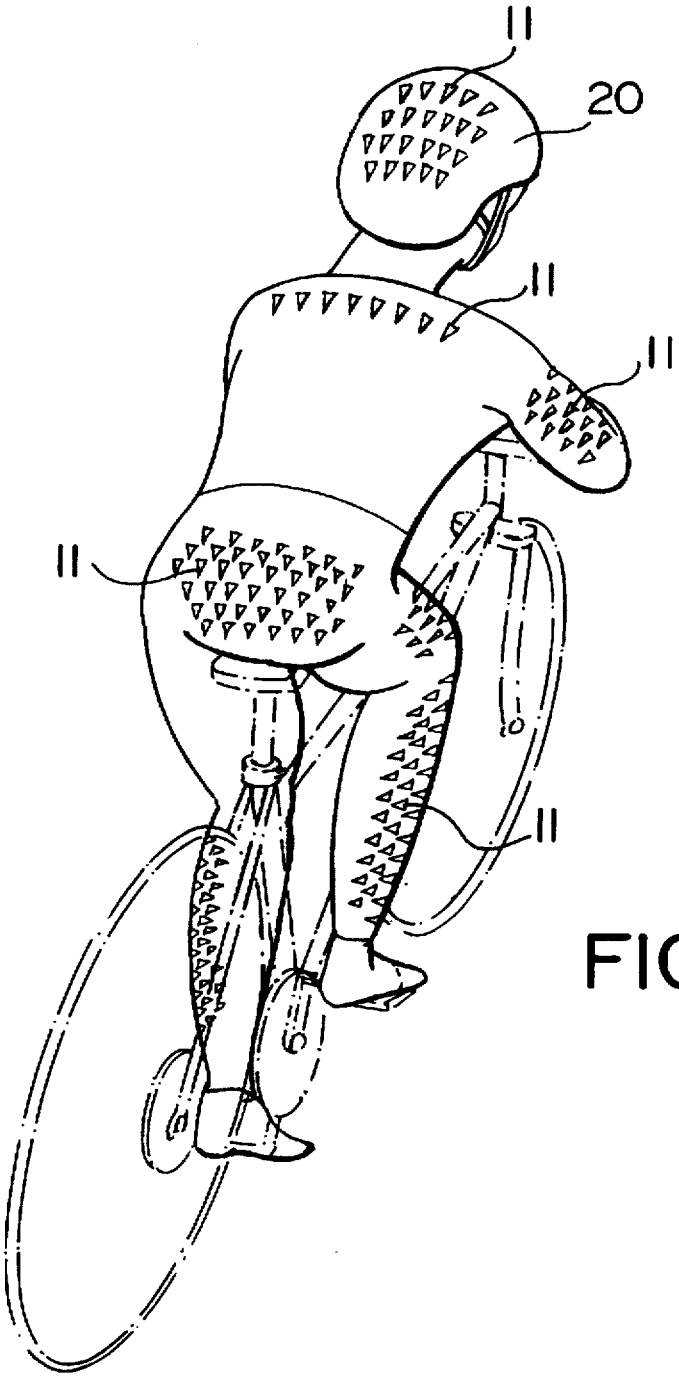
FIG. 7 is a rear perspective view of a cyclist using a arrangement in accordance with the invention.

The invention is applicable to other sports, such as cycling and skiing, where the athlete's body moves through a fluid medium, in this case air. In the case of cycling, as shown in FIG. 7, the vortex generators 11, preferably Stephen's type generators, are similarly attached to the athlete's body just upstream of points where boundary layer separation would tend to occur, i.e. on the head, over the buttock and on the inner and outer sides of the arms and legs. In the case of the head, they can be conveniently attached to the back of the cyclist's helmet, as shown in FIG. 7. Over the arms and legs, they are of course oriented so as to keep the air flowing inward around the curved surface into contact therewith. Although not shown, as will be appreciated by one skilled in the art, they can also be attached to the sides of the body so as to function in a similar manner.

The vortex generators for the arms and legs may also be stub cylinders or caps as shown in FIGS. 4*d* and 4*e*.

The important point is that the vortex generators are placed upstream of the points of anticipated flow separation. By delaying the onset of flow separation at the trailing surfaces form drag is reduced. The invention can result in a reduction in overall drag in the order of 5 to 10%.

A ski suit can be designed in a manner similar to the cyclist's suit shown in FIG. 7. In the case of a skier, there is no need for generators on the back. They can just be placed on the trailing curves surfaces of the arms, legs, and sides of the torso, and to a lesser extent on the back of the head.

Although shown as staggered, the rows of vortex generators can of course be arranged in line, and under some circumstances this may be a more efficient arrangement.

I claim:

1. A wearable article for use by a person moving rapidly through a fluid medium in a longitudinal direction, said longitudinal direction defining a direction of fluid flow relative to said person, and said article having a drag reduction arrangement comprising an upstream row and at least one additional row of spaced vortex generators secured to said article, at least said upstream row being located on a line at least just upstream of a surface that is curved in said longitudinal direction, each said row of vortex generators being arranged so as to extend in a transverse direction relative to said fluid flow when said article is worn, and said vortex generators being oriented so as to create trailing vortices extending in said longitudinal direction and having a height sufficient to extend about ¼ to ½ the way into a boundary layer formed by the motion of the person through the fluid medium, whereby said vortex generators delay the onset of boundary layer separation and thereby reduce form drag.

2. A wearable article as claimed in claim 1, wherein said rows are arranged in an array extending at least over an apex of said curved surface.

3. A wearable article as claimed in claim 2, wherein the vortex generators of adjacent said rows are staggered in the transverse direction.

4. A wearable article as claimed in claim 1, wherein the height of said vortex generators is at least about ¼ inch.

5. A wearable article as claimed in claim 1, wherein said vortex generators are Stephen's vortex generators having leading edges directed toward oncoming fluid flow.

6. A wearable article as claimed in claim 1 comprising a swimsuit including a curved portion designed to be worn around the buttock region of the person, said curved portion providing said curved surface.

7. A wearable article as claimed in claim 1 comprising a helmet including a curved portion designed to extend over the back of the head of the person, said curved portion providing said curved surface.

8. A wearable article as claimed in claim 1 comprising a body suit including curved portions for extending around the torso and limbs of the person, a said curved surface being formed by each of said curved portions.

9. A method of reducing the drag of a person moving rapidly through a fluid medium in a longitudinal direction, said longitudinal direction defining a direction of fluid flow relative to said person, said fluid defining a boundary layer in the vicinity of the person, said method comprising the step of arranging an upstream row and at least one additional row of spaced vortex generators on said person, each said row of vortex generators being arranged so as to extend in a transverse direction relative to said fluid, and at least said upstream row being located upstream of a line of boundary layer flow separation, said vortex generators being oriented so as to create trailing vortices extending in said longitudinal direction and having a height sufficient to extend about ¼ to ½ the way into said boundary layer, said trailing vortices delaying the onset of boundary layer separation and thereby reducing form drag.

10. A method article as claimed in claim 9, wherein said rows are arranged in an array extending at least over said curved surface to the line of boundary layer separation.

11. A method as claimed in claim 10, wherein the vortex generators of adjacent said rows are staggered in the transverse direction.

12. A method as claimed in claim 9, wherein the height of said vortex generators is at least about ¼ inch.

13. A method as claimed in claim 9, wherein said vortex generators are Stephen's vortex generators having their leading edges directed toward oncoming fluid flow.

14. A method as claimed in claim 9 wherein said vortex generators are provided on a swimsuit including a curved portion designed to be worn around the buttock region of the person.

15. A method as claimed in claim 9 wherein said vortex generators are provided on a helmet including a curved portion designed to extend over the back of the head of the person, said boundary layer separation occurring on said curved portions.

16. A method as claimed in claim 9 wherein said vortex generators are provided on a body suit including curved portions for extending around the torso and limbs of the person, said boundary layer separation occurring on said curved portions.

* * * * *